US007796106B2

(12) United States Patent
Ha

(10) Patent No.: US 7,796,106 B2
(45) Date of Patent: Sep. 14, 2010

(54) LIQUID CRYSTAL DISPLAY

(75) Inventor: Chunghun Ha, Seoul (KR)

(73) Assignee: Samsung Electronics Co., Ltd. (KR)

( * ) Notice: Subject to any disclaimer, the term of this patent is extended or adjusted under 35 U.S.C. 154(b) by 912 days.

(21) Appl. No.: 11/610,816

(22) Filed: Dec. 14, 2006

(65) Prior Publication Data

US 2007/0164964 A1 Jul. 19, 2007

(30) Foreign Application Priority Data

Jan. 13, 2006 (KR) ..... 10-2006-0003996

(51) Int. Cl.
*G09G 3/36* (2006.01)

(52) U.S. Cl. ..... 345/88; 345/90; 345/92

(58) Field of Classification Search ..... 345/88
See application file for complete search history.

(56) References Cited

U.S. PATENT DOCUMENTS

| | | | | |
|---|---|---|---|---|
| 4,901,066 | A * | 2/1990 | Kobayashi et al. | 345/94 |
| 6,014,193 | A * | 1/2000 | Taira et al. | 349/73 |
| 6,552,707 | B1 * | 4/2003 | Fujiyoshi | 345/98 |
| 7,358,949 | B2 * | 4/2008 | Chen | 345/92 |
| 7,548,288 | B2 * | 6/2009 | Kim et al. | 349/84 |
| 2001/0017607 | A1 * | 8/2001 | Kwon et al. | 345/87 |
| 2003/0123013 | A1 * | 7/2003 | Han et al. | 349/149 |
| 2005/0088385 | A1 * | 4/2005 | Elliott et al. | 345/87 |
| 2005/0243044 | A1 | 11/2005 | Kang et al. | |
| 2006/0044292 | A1 * | 3/2006 | Shen et al. | 345/204 |
| 2006/0081850 | A1 * | 4/2006 | Lee et al. | 257/72 |
| 2007/0097072 | A1 * | 5/2007 | Kim et al. | 345/103 |

FOREIGN PATENT DOCUMENTS

| | | | |
|---|---|---|---|
| CN | 1573459 | A | 12/2008 |
| WO | 2004092812 | A1 | 10/2004 |

* cited by examiner

*Primary Examiner*—Richard Hjerpe
*Assistant Examiner*—Dorothy Webb
(74) *Attorney, Agent, or Firm*—Cantor Colburn LLP

(57) ABSTRACT

A liquid crystal display including a substrate, first and second rows of pixels each formed on the substrate and including a plurality of pixels, a first gate line extending in a row direction on the substrate and connected to the first row of pixels, a second gate line extending in the row direction on the substrate and connected to the first and second rows of pixels, a third gate line extending in the row direction on the substrate and connected to the second row of pixels and first and second data lines extending in a column direction on the substrate to transmit data voltages to a pixel group consisting of three columns of pixels.

25 Claims, 7 Drawing Sheets

LIQUID CRYSTAL DISPLAY

This application claims priority to Korean Patent Application 10-2006-0003996 filed on Jan. 13, 2006 and all the benefits accruing therefrom under 35 U.S.C. §119, the contents of which are herein incorporated by reference in its entirety.

BACKGROUND OF THE INVENTION

1. Field of the Invention

The present invention relates to a liquid crystal display, and more particularly, to a liquid crystal display wherein the brightness and display quality thereof can be improved and the production costs thereof can also be reduced.

2. Description of the Related Art

A liquid crystal display (LCD) can be advantageously manufactured to be smaller, lightweight and to have a larger screen as compared with a conventional cathode ray tube (CRT), and thus, it has been actively developed. In particular, since the liquid crystal display has been developed enough to perform a function of a flat panel display, it is used not only in a monitor for a desktop computer and a large-sized display but also in a liquid crystal of a mobile phone, a PDA, a digital camera and a camcorder. Therefore, the application range of the liquid crystal display is rapidly expanded.

In the liquid crystal display, desired images can be obtained by applying voltages to two electrodes to generate an electric field on a liquid crystal layer and adjusting the intensity of the generated electric field to adjust the transmissivity of light passing through the liquid crystal layer.

In order to prevent degradation phenomena occurring when an electric field is applied to the liquid crystal layer in one direction for a long time, a polarity of a data signal relative to a common voltage is reversed according to frames, rows or dots, and a data signal with a reversed polarity is then used. In other words, a dot inversion, an N+1 inversion and a line inversion are used.

However, there is a problem in that power consumption is increased in the case of the dot inversion and the N+1 inversion, whereas vertical blurs occur due to the difference in kickback and coupling capacitance between pixels in the case of the line inversion.

BRIEF SUMMARY OF THE INVENTION

One exemplary embodiment provides a liquid crystal display wherein an arrangement of gate lines, data lines and pixels is changed to reduce vertical blurs and power consumption and to improve a charging ratio of a pixel electrode and visibility thereof.

Another exemplary embodiment provides a liquid crystal display including a substrate, first and second rows of pixels each formed on the substrate and including a plurality of pixels, a first gate line extending in a row direction on the substrate and connected to the first row of pixels, a second gate line extending in the row direction on the substrate and connected to the first and second rows of pixels, a third gate line extending in the row direction on the substrate and connected to the second row of pixels and first and second data lines extending in a column direction on the substrate to transmit data voltages to a pixel group consisting of three columns of pixels.

In another exemplary embodiment, the liquid crystal display may further include a first gate driving unit connected to the first gate line, a second gate driving unit connected to the second gate line and a third gate driving unit connected to the third gate line.

In another exemplary embodiment, the first, second and third gate driving units are integrated on the substrate. In another exemplary embodiment, the first and second gate driving units are integrated to be opposed to each other in the row direction.

In another exemplary embodiment, the first, second and third gate driving units are configured to sequentially apply gate turn on voltages to the first, second and third gate lines for two horizontal periods (2 H). In another exemplary embodiment, the gate turn on voltages applied to the first, second and third gate lines are overlapped for ⅓ to 1 horizontal period.

In another exemplary embodiment, polarities of the data voltages applied respectively to the first and second data lines are different from each other. In an alternative exemplary embodiment, the polarities of the data voltages applied respectively to the first and second data lines may be different for adjacent pixels. In another alternative exemplary embodiment, the polarities of the data voltages applied respectively to the first and second data lines may be different for every frame.

In another exemplary embodiment, at least one of three adjacent pixels in the first row of pixels is connected to the first data line while the others of the three pixels in the first row of pixels are connected to the second data line and at least one of three pixels in the second row of pixels is connected to the second data line while the others of the three pixels in the second row of pixels are connected to the first data line.

In another exemplary embodiment, each first column of pixels in the first and second rows of pixels is connected to the first data line, each second column of pixels in the first and second rows of pixels is connected to the first or second data line and each third column of pixels in the first and second rows of pixels is connected to the second data line.

In another exemplary embodiment, two of three consecutive pixels in the first row of pixels are connected to the first data line while the other of the three pixels in the first row of pixels is connected to the second data line and two of three pixels in the second row of pixels are connected to the second data line while the other of the three pixels in the second row of pixels is connected to the first data line.

In another exemplary embodiment, two of the three columns of pixels in the first row of pixels are connected to the first gate line, the other column of pixels in the first row of pixels and one of the three columns of pixels in the second row of pixels are connected to the second gate line and the other two columns of pixels in the second row of pixels are connected to the third gate line.

In another exemplary embodiment, the three columns of pixels in the first and second rows of pixels are provided with the same numbers of red pixels, green pixels and blue pixels each having the same area.

In another exemplary embodiment, each pixel includes a switching element connected to any one of the first to third gate lines and any one of the first and second data lines.

Another exemplary embodiment provides a method for driving a liquid crystal display including a substrate, first and second rows of pixels each formed on the substrate and including a plurality of pixels, a first gate line extending in a row direction on the substrate and connected to the first row of pixels, a second gate line extending in the row direction on the substrate and connected to the first and second rows of pixels, a third gate line extending in the row direction on the substrate and connected to the second row of pixels and first and second data lines extending in a column direction on the substrate to transmit data voltages to a pixel group consisting of three columns of pixels. The method includes the steps of applying the data voltages to the first and second data lines and applying gate turn on voltages to the first, second and third gate lines, respectively, for two horizontal periods (2 H).

In another exemplary embodiment, the gate turn on voltages are applied to the first, second and third gate lines, respectively, for at least ⅔ horizontal period.

In another exemplary embodiment, the gate turn on voltages applied to the first to third gate lines may be overlapped with one another for ⅓ to 1 horizontal period.

In another exemplary embodiment, polarities of the data voltages applied respectively to the first and second data lines are different from each other. In an alternative exemplary embodiment, the polarities of the data voltages applied respectively to the first and second data lines may be different for adjacent pixels. In another alternative exemplary embodiment, the polarities of the data voltages applied respectively to the first and second data lines may be different for every frame.

In another exemplary embodiment, a method of forming a liquid crystal display includes forming first and second rows of pixels on a substrate, disposing a first gate line, a second gate line and a third gate line on the substrate and disposing first and second data lines on the substrate in a column direction. Each of the first and second rows of pixels include a plurality of pixels defining a pixel group including three columns of pixels. The first gate line, second gate line and third gate line extend in a row direction. The first and second data lines transmit a data voltage to the pixel group. The first gate line is connected to the first row of pixels, the second gate line is connected to the first and second row of pixels and the third gate line is connected to the second row of pixels.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Figure 1:
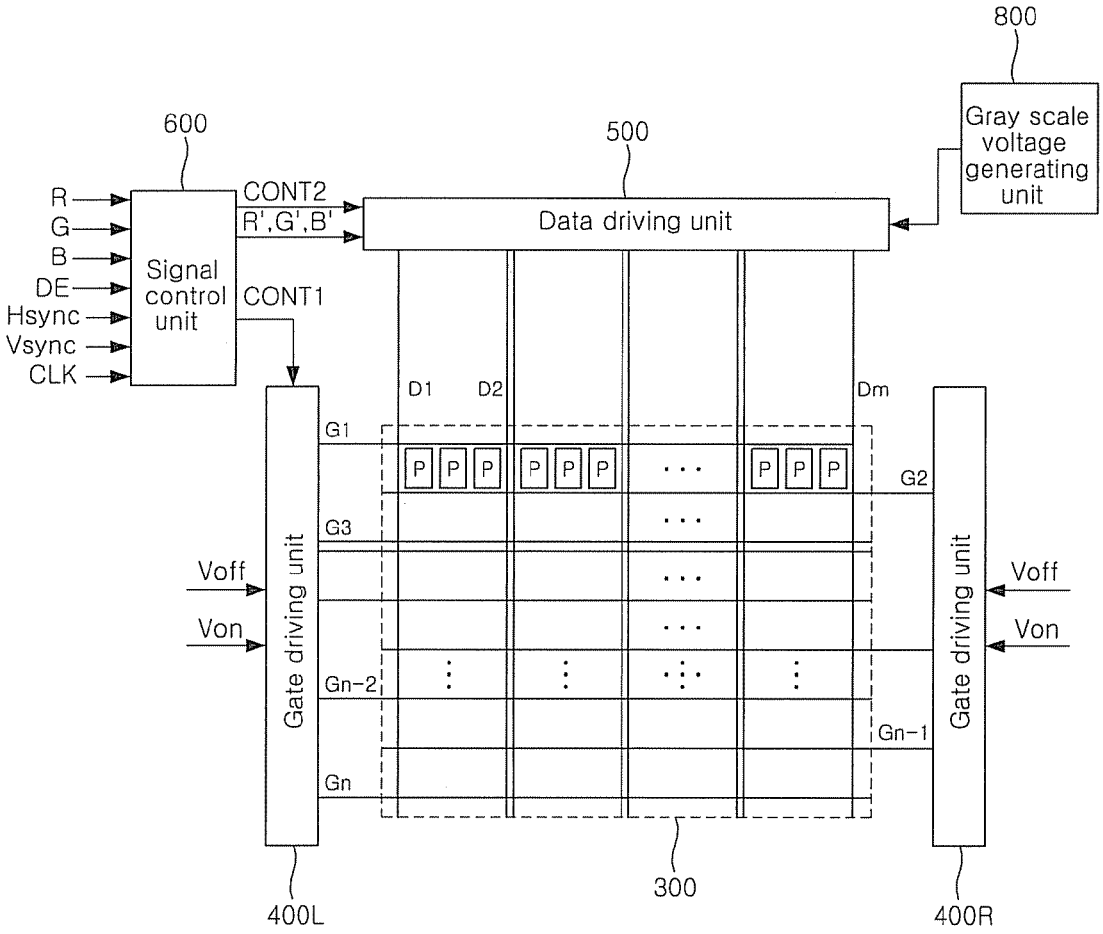
FIG. 1 is a block diagram of an exemplary embodiment of a liquid crystal display according to the present invention.

Hereinafter, preferred embodiments of the present invention will be explained in detail with reference to the accompanying drawings. However, the present invention is not limited to the embodiments described below but will be implemented in various different forms. The embodiments are provided only to complete the disclosure of the present invention and fully convey the scope of the present invention to those skilled in the air. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "below", "lower", "above", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected.

Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Figure 2:
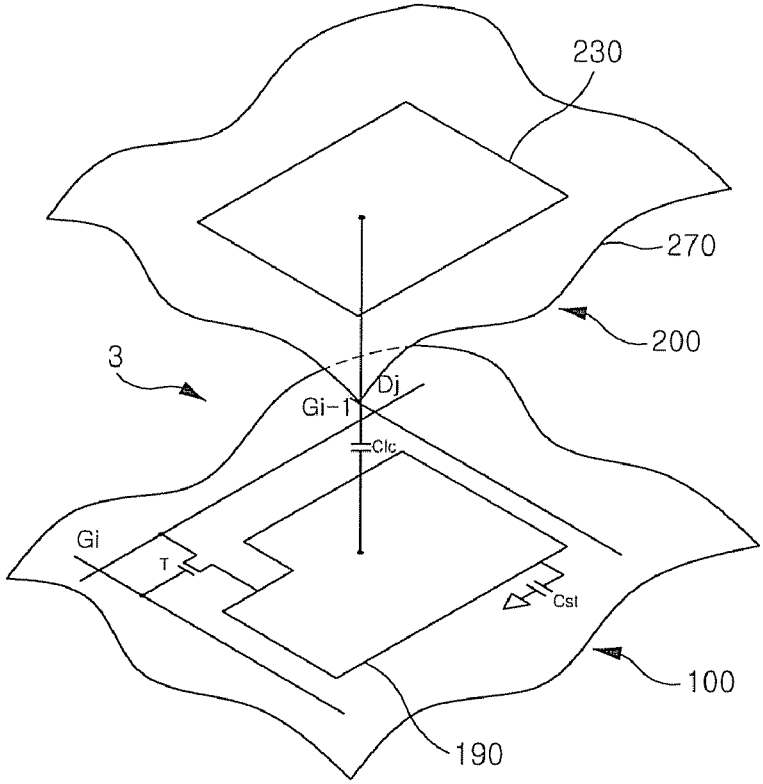
FIG. 2 is an equivalent circuit diagram of an exemplary embodiment of a pixel of a liquid crystal display according to the present invention.

FIG. 1 is a block diagram of an exemplary embodiment of a liquid crystal display (LCD) according to the present invention and FIG. 2 is an equivalent circuit diagram of an exemplary embodiment of a pixel of the liquid crystal display according to the present invention.

Referring to FIGS. 1 and 2, the liquid crystal display according to this embodiment includes a liquid crystal panel assembly 300, gate driving units 400L and 400R and a data driving unit 500 each of which is connected to the liquid crystal panel assembly 300. The liquid crystal display further includes a gray scale voltage generating unit 800 connected to the data driving unit 500 and a signal control unit 600 for controlling the above assembly and units.

In view of an equivalent circuit, the liquid crystal panel assembly 300 includes a plurality of display signal lines D1 to Dm and G1 to Gn and a plurality of pixels P connected to the plurality of display signal lines and generally arranged in a matrix form.

The display signal lines G1 to Gn and D1 to Dm include a plurality of gate lines G1 to Gn for transmitting gate signals (referred to as "scanning signals") and a plurality of data lines D1 to Dm for transmitting data signals. In general, the gate lines G1 to Gn extend substantially in a row direction and are substantially parallel to one another while the data lines D1 to Dm extend substantially in a column direction and are substantially parallel to one another.

Each of the pixels includes a switching element T connected to one of the display signal lines G1 to Gn and D1 to Dm, and a liquid crystal capacitor Clc and a storage capacitor Cst connected to the switching element. In exemplary embodiments, the storage capacitor Cst may be omitted. In other exemplary embodiments, the switching element T may be a three-terminal element formed on a lower display plate 100. Control and input terminals of the switching element T are connected to one of the gate lines G1 to Gn and one of the data lines D1 to Dm, respectively. An output terminal of the switching element T is connected to the liquid crystal capacitor Clc and the storage capacitor Cst.

Referring to FIG. 2, the liquid crystal capacitor Clc includes a pixel electrode 190 disposed on the lower display plate 100 and a common electrode 270 disposed on an upper display plate 200 as two terminals A liquid crystal layer 3 disposed between the two electrodes 190 and 270 functions as a dielectric. The pixel electrode 190 is connected to the switching element T, while the common electrode 270 is formed on a surface of the upper display plate 200, such as on an entire surface, and applied with a common voltage Vcom. Alternative exemplary embodiments may include configurations where, the common electrode 270 may be formed on the lower display plate 100. In other exemplary embodiments, the pixel and common electrodes 190 and 270 may be manufactured in the from of a line or bar.

In one exemplary embodiment, the storage capacitor Cst may be formed by overlapping an additional signal line (not shown) and the pixel electrode 190, and a predetermined voltage such as the common voltage Vcom is applied to the additional signal line.

To implement a color display, each pixel may uniquely display one of a number of colors, such as one of three primary colors (spatial division) or each pixel may alternately display three colors over time (time division) such that a desired color can be recognized by mean of the spatial and temporal summation of the three colors, such as three primary colors. FIG. 2 shows the spatial division, with each pixel including a color filter 230 for displaying one color on a region corresponding to the pixel electrode 190. Alternative exemplary embodiments may include configurations where the color filter 230 may be formed above or below the pixel electrode 190 of the lower display plate 100.

In exemplary embodiments, the color of the color filter 230 may be one of three primary colors such as red (R), green (G) or blue (B). For convenience in explanation, pixels may referred to as a red, green or blue pixel according to the color displayed by the pixel.

An outer surface of one or both of the two display plates 100 and 200 of the liquid crystal panel assembly 300 may be provided with a polarizer (not shown) for polarizing light. Alternative embodiments include configurations where a compensating plate (not shown) for compensating for the reflectivity anisotropy of the liquid crystal layer may be interposed between the polarizer and the display plate 100 and/or 200.

The gray scale voltage generating unit 800 generates a plurality of gray scale voltages related to the brightness of the liquid crystal display, i.e. data signals. In one preferred exemplary embodiment, one set of the gray scale voltages is positive relative to the common voltage Vcom while the other set of the plurality of gray scale voltages is negative relative to the common voltage Vcom.

The data driving unit 500 is connected to the data lines D1 to Dm of the liquid crystal panel assembly 300 to select a gray scale voltage from the gray scale voltage generating unit 800 and to apply the selected gray scale voltage to the data lines D1 to Dm as a data signal.

Referring again to FIG. 1, the gate driving units 400L and 400R are disposed at the left and right sides, respectively, of the liquid crystal panel assembly 300 and connected to any of a number of consecutive gate lines G1 to Gn. In one exemplary embodiment, gate driving units 400L and 400R are connected to at least one gate line of a group of three consecutive gate lines G1 to G3, . . . , Gn−2 to Gn, respectively, to apply a gate signal consisting of a gate turn on voltage Von and a gate turn off voltage Voff to the gate lines G1 to Gn. As shown in FIG. 1, the intermediate gate line G2 of the three gate lines G1, G2 and G3 is connected to the right gate driving unit 400R and the other gate lines G1 and G3 are connected to the left gate driving unit 400L. Hereinafter, the arrangement of the gate lines, the data lines and the pixels will be explained with reference to the drawings.

Figure 3:
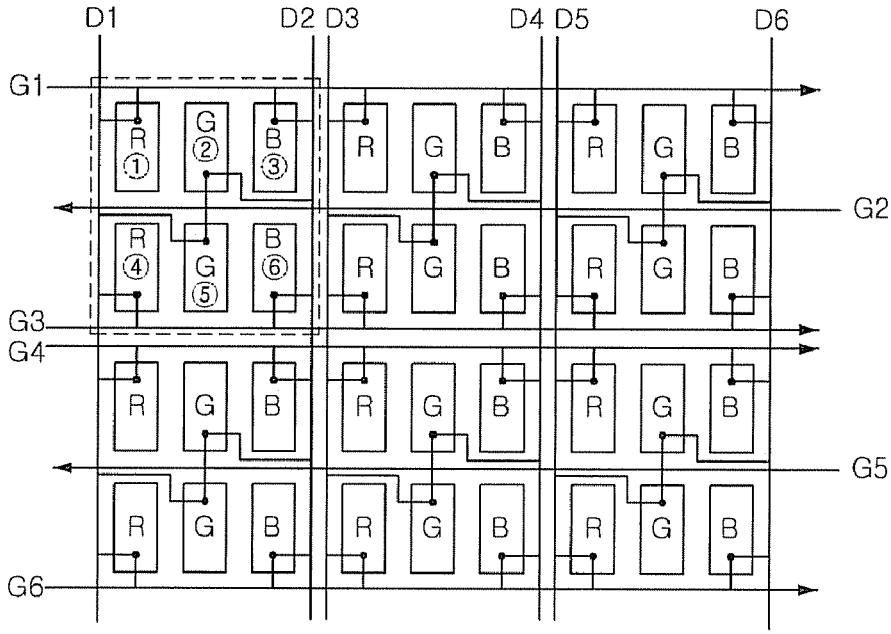
FIG. 3 is a schematic plan view of an exemplary embodiment of a liquid crystal display according to the present invention.

FIG. 3 is a schematic plan view of an exemplary embodiment of a liquid crystal display according to the the present invention.

Referring to FIG. 3, three gate lines G1 to G3 and G4 to G6 are disposed at the top and bottom of two rows of pixels and therebetween. The gate lines may be connected to the pixels through thin film transistors T. Each of a pair of data lines, such as D1 and D2, D3 and D4 and D5 and D6, is disposed at the leftmost and rightmost sides of three columns of pixels and is connected to the pixels through the thin film transistors T.

A number of pixels are disposed in a row at the top and bottom, respectively, defining a group of pixels. Data lines D1 and D2, D3 and D4, and D5 and D6 are disposed at outer sides of the grouped pixels, respectively. The pixels in the top and bottom rows adjacent to the data lines D1 and D2, D3 and D4, and D5 and D6, respectively, are connected to the adjacent data lines D1 and D2, D3 and D4, and D5 and D6, respectively. Center pixels of the grouped pixels disposed in the top row are connected to different data lines from the center pixels disposed in the bottom row. As shown in FIG. 3, center pixels disposed at the bottom row are connected to data lines D1, D3, D5. Center pixels disposed at the top row are connected to data lines or D2, D4, D6, respectively. In one exemplary embodiment, three pixels are disposed in a row at the top and bottom of a group of pixels, respectively. Gate lines G1 to G3 and G4 to G6 are disposed at the top, middle and bottom of each group of the pixels. A set of two pixels among pixels adjacent to the gate lines G1 to G3 and G4 to G6 is connected to each of three gate lines G1 to G3 and G4 to G6.

In other words, first gate lines G1 and G4 are connected to the pixels positioned at the first and third columns in the first row through the thin film transistors. Second gate lines G2 and G5 are connected to the pixels positioned at the second column in the first row and the second column in the second row through the thin film transistors. Third gate lines G3 and G6 are connected to the pixels positioned at the first and third columns in the second row through the thin film transistors.

First data lines D1, D3 and D5 are connected to the pixels positioned at the first column in the first row and the first and second columns in the second row. Second data lines D2, D4 and D6 are connected to the pixels positioned at the second and third columns in the first row and the third column in the second row.

As described above, the repeated unit of the pixels (shown by a dotted line in FIG. 3) includes six pixels consisting of three top pixels and three bottom pixels. In this case, the three top and/or bottom pixels include red (R), green (G) and/or blue (B) pixels. A plurality of the aforementioned repeated unit of pixels is substantially arranged in a matrix form. In exemplary embodiments, the red, green and blue pixels in the repeated unit may have the same area and/or number.

Referring to FIG. 3, a first pixel in the first row is referred to as a first pixel, and the other two pixels in the first row are referred to as second and third pixels, respectively (as indicated by the circled numerals "1," "2" and "3"). Further, the first pixel in the second row is referred to as a fourth pixel, and the other two pixels in the second row are referred to as fifth and sixth pixels, respectively (as indicated by the circled numerals "4," "5" and "6"). In addition, the gate lines of a group of three gate lines, such as gate lines G1, G2 and G3, are referred to as first to third gate lines, respectively. Two data lines, such as data lines D1 and D2, are referred to as first and second data lines.

The first pixel is connected to the first gate line G1 and the first data line D1, the second pixel is connected to the second line G2 and the second data line D2, and the third pixel is connected to the first gate line G1 and the second data line D2. Further, the fourth pixel is connected to the third gate line G3 and the first data line D1, the fifth pixel is connected to the second gate line G2 and the first data line D1, and the sixth pixel is connected to the third gate line G3 and the second data line D2.

The present invention is not limited thereto. In alternative exemplary embodiments, the first to sixth pixels may be connected to the first to third gate lines G1, G2 and G3 and the first and second data lines D1 and D2 in various ways. In exemplary embodiments, a half of the pixels (such as taken in rows of the repeated unit) can be connected to the first and second data lines D1 and D2 and each third (such as taken in columns of the repeated unit) of the pixels can be connected to the first to third gate lines G1, G2 and G3. In one exemplary embodiment, the aforementioned connection between the second and fifth pixels (center pixels) and the data lines may be changed. The second pixel may be connected to the second gate line G2 and the first data line D1, while the fifth pixel may be connected to the second gate line G2 and the second data line D2.

The number of data lines may be reduced by ⅓ through the aforementioned arrangement. Advantageously, the number of data driving ICs for driving the data lines may also be reduced. Further, the number of gate lines can be reduced by ¾. Advantageously, the number of gate driving ICs for driving the gate lines may also be reduced. An aperture ratio of the liquid crystal display may then be increased through the reduction in the number of the gate lines. Furthermore, an area of a circuit (for example, a shift register) for driving the gate lines can be reduced by ⅔ and a margin of the area of the gate driving circuit, which is difficult to repair, may be increased. Although it has been in the this embodiment that the gate driving portions 400L and 400R are disposed at both sides of the liquid crystal panel assembly 300, the present invention is not limited thereto. Alternative exemplary embodiments may include configurations where, the gate driving portions may be disposed at one side of the liquid crystal panel assembly 300. Furthermore, the exemplary embodiments described hereinabove may improve the visibility of the liquid crystal display by essentially applying the black matrix to each dot.

Hereinafter, the structure of the lower display plate of the liquid crystal panel assembly according to the aforementioned embodiment will be explained with reference to the drawings.

Figure 4:
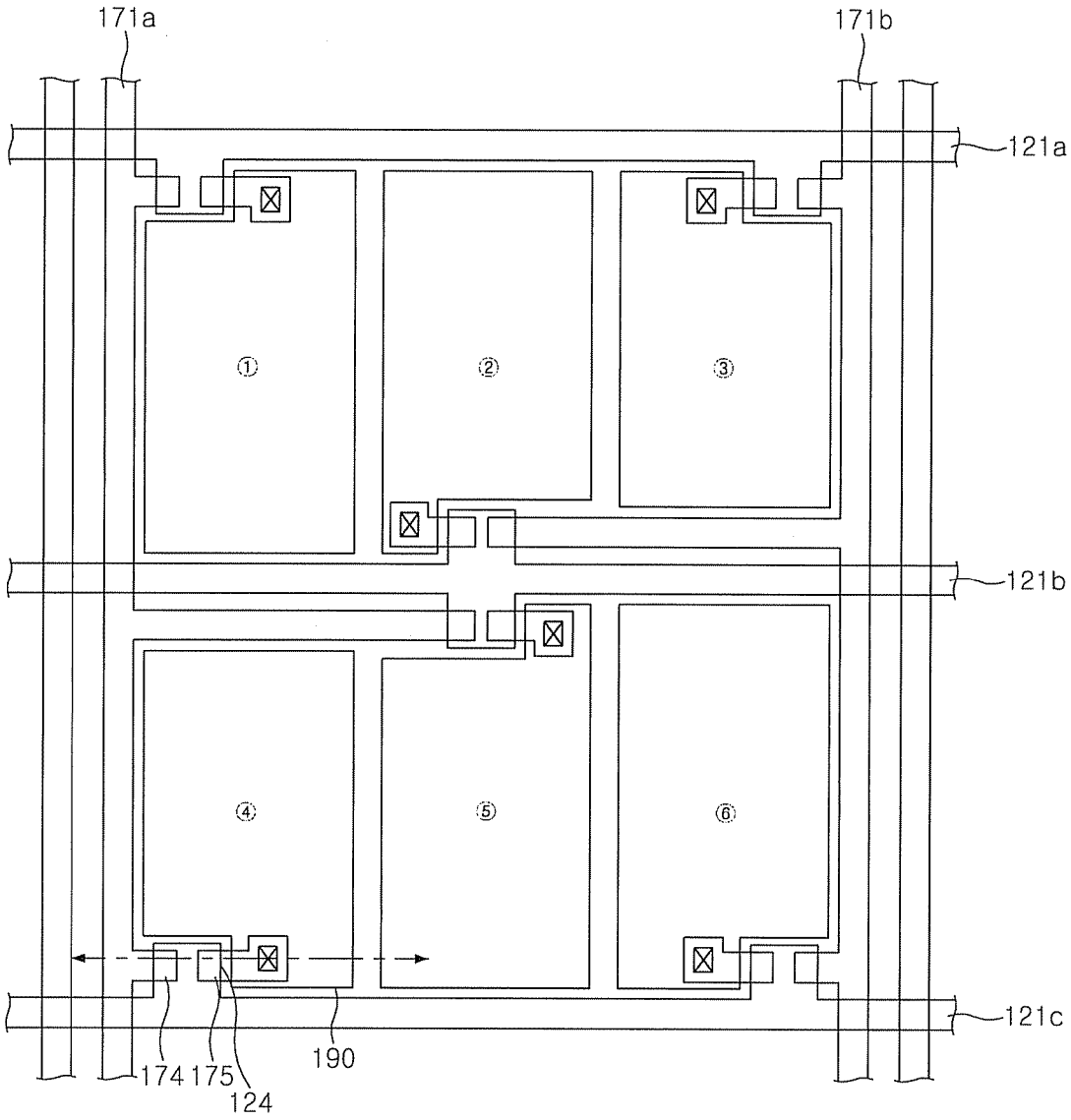
FIG. 4 is a view illustrating the arrangement of an exemplary embodiment of a thin film transistor display panel according to the present invention.
Figure 5:
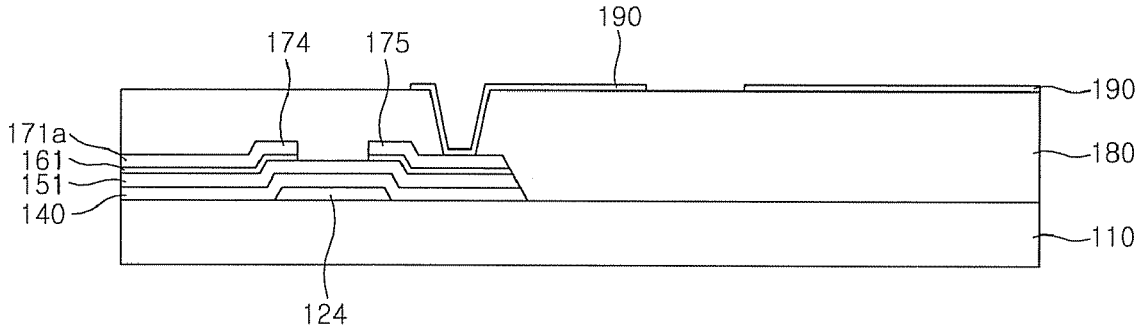
FIG. 5 is a cross-sectional view of the thin film transistor display panel taken along line A-A of FIG. 4.

FIG. 4 is a view illustrating the arrangement of an exemplary embodiment of a thin film transistor display panel according to the present invention and FIG. 5 is a sectional view of the thin film transistor display panel taken along line A-A of FIG. 4.

Referring to FIGS. 4 and 5, the thin film transistor display panel includes a plurality of gate lines 121*a*, 121*b* and 121*c* formed on an insulating substrate 110, such as a transparent glass substrate. A plurality of storage electrode lines (not shown) may also be formed together with the gate lines. The gate lines 121*a*, 121*b* and 121*c* primarily extend in a transverse direction and a portion of each gate line 121*a*, 121*b* or 121*c* protrudes upward and/or downward to form a gate electrode 124. In one exemplary embodiment, three gate lines 121*a*, 121*b* and 121*c* may be repeated multiple times and may be considered as a group of gate lines.

A gate insulating film 140 is formed on the gate lines 121*a*, 121*b* and 121*c*. The gate insulating film 140 may include an insulating film, including but not limited to, an oxide film or a nitride film. An active layer 151 is formed on the gate insulating film 140. The active layer 151 may include, but is not limited to, a silicone film. An ohmic contact layer 161 is formed on the active layer 151. The ohmic contact layer 161 may include, but is not limited to, a silicide or impurity doped silicone film. A drain electrode 175 and a source electrode 174 and a plurality of data lines 171*a* and 171*b* connected to the source electrode 174 are formed on the ohmic contact layer 161.

The data lines 171*a* and 171*b* primarily extend in the lengthwise direction. In one exemplary embodiment, two data lines 171*a* and 171*b* may be repeated multiple times and may be considered as a group of data lines.

The source electrode 174 and the drain electrode 175 are separated from each other and are positioned at the opposite sides of the gate electrode 124. A thin film transistor may be formed to include the gate electrode 124, the source electrode 174 and the drain electrode 175. Further, a channel of the thin film transistor may be formed in the active layer 151 between the source electrode 174 and the drain electrode 175.

A passivation film 180 is formed on the thin film transistor considered as including the gate electrode 124, the source electrode 174 and the drain electrode 175. Contact holes exposing portions of the gate lines 121*a*, 121*b* and 121*c*, the drain electrode 175 and the data lines 171*a* and 171*b* are formed in the passivation film 180. A plurality of pixel electrodes 190 is formed on the passivation film 180 and contact pads (not shown) are formed on the contact holes. The pixel electrodes 190 may include, but are not limited to, indium tin oxide (ITO) or indium zinc oxide (IZO).

The pixel electrode 190 is physically and electrically connected to the drain electrode 175 through any one of the contact pads, such that a data voltage is applied from the drain electrode to the pixel electrode. The pixel electrode generates an electric field together with the common electrode 270 (such as shown in FIG. 2) and causes molecules of the liquid crystal layer 3 between the two electrodes 190 and 270 to be rearranged.

An alignment film (not shown) for aligning the liquid crystal layer may be coated on the aforementioned pixel electrode 190.

In preferred exemplary embodiments, the gate lines 121*a*, 121*b* and 121*c*, the data lines 171*a* and 171*b*, the source electrode 174, and the drain electrode 175 may include Cr, MoW, Cr/Al, Cu, Al(Nd), Mo/Al, Mo/Al(Nd) and/or Cr/Al (Nd).

Hereinafter, an exemplary embodiment of the general operation of the liquid crystal display shown in FIG. 1 will be explained with reference to the aforementioned thin film transistor display panel.

The gray scale voltage generating unit 800 generates two sets of gray scale voltages (data signals) associated with the transmissivity of the pixel. One set of gray scale voltages is positive relative to the common voltage Vcom, while the other set is negative relative to the common voltage Vcom. The gate driving unit 400 is connected to the gate lines G1 to Gn of the liquid crystal panel assembly 300 to apply a gate signal consisting of a gate turn on voltage Von and a gate turn off voltage Voff to the gate lines G1 to Gn. The data driving unit 500 is connected to the data lines D1 to Dm of the liquid crystal panel assembly 300 to select a gray scale voltage from the gray scale voltage generating unit 800 and to apply the selected gray scale voltage as a data signal to the pixel.

In exemplary embodiments, a plurality of gate driving integrated circuits or data driving integrated circuits are mounted on a tape carrier package (TCP) (not shown) in the form of a chip such that the TCP can be attached to the liquid crystal panel assembly 300. In alternative exemplary embodiments, the integrated circuit chips may be attached directly onto the glass substrate without the TCP (referred to a chip on glass (COG) mounting). Other alternative embodiments include configurations with a circuit for performing the same function as the integrated circuits formed directly on the liquid crystal panel assembly 300 together with the thin film transistor of the pixel. A signal control unit 600 controls the operations of the units of the LCD, such as the gate driving unit 400 and the data driving unit 500.

The signal control unit 600 receives input image signals R, G and B and input control signals for controlling the display of the input image signals, including but not limited to, a vertical synchronization signal Vsync, a horizontal synchronization signal Hsync, a main clock CLK, a data enable signal DE, from an external graphic controller (not shown). The image signals R, G and B are processed to satisfy the operating condition of the liquid crystal panel assembly 300 based on the input image signals R, G and B and the input control signals from the signal control unit 600, and gate and data control signals CONT1 and CONT2 are generated. Then, the gate control signal CONT1 is transmitted to the gate driving unit 400.

The processing of the image signals R, G and B includes the operation for rearranging the image signal R, G and B in accordance with the pixel arrangement of the liquid crystal panel assembly. The gate control signal CONT1 may include, but is not limited to, a vertical synchronization start signal STV for indicating the start of the output of the gate turn on voltage Von, a gate clock signal CPV for controlling the output timing of the gate turn on voltage Von and an output enable signal OE for defining the duration of the gate turn on voltage Von. The data control signal CONT2 may include, cut is not limited to, a horizontal synchronization start signal STH for indicating the start of the transmission of the image data DAT, a load signal TP for instructing to apply corresponding data voltages to the data lines D1 to Dm, a reverse signal RVS for reversing the polarity of the data voltage relative to the common voltage Vcom (hereinafter, 'the polarity of the data voltage relative to the common voltage' is shortened to as 'the polarity of the data voltage') and a data clock signal CLK.

The data driving unit 500 sequentially receives a set of the image data DAT for a half of one row of pixels according to the data control signal CONT2 transmitted from the signal control unit 600 and converts the received image data DAT into corresponding data voltages by selecting the gray scale voltage corresponding to the respective image data DAT transmitted from the gray scale voltages from the gray scale voltage generating unit 800. The data driving unit 500 then applies the converted data voltages to the corresponding data lines D1 to Dm.

The gate driving unit 400 sequentially applies the gate turn on voltages Von to the gate lines G1 to Gn according to the gate control signal CONT1 transmitted from the signal control unit 600 to turn on the switching element T connected to the gate lines G1 to Gn, so that the data voltages applied to the data lines D1 to Dn are in turn applied to the corresponding pixels through the turned-on switching element T.

The difference between the common voltage Vcom and the data voltage applied to the pixel is expressed as a charging voltage of the liquid crystal capacitor Clc, i.e. a pixel voltage.

The arrangement of the liquid crystal molecules is changed depending on the magnitude of the pixel voltage, and thus, the polarization of light passing through the liquid crystal layer 3 is changed. This variation of the polarization of light may be expressed as a variation of the transmissivity of light through the polarizer (not shown) attached to the display plates 100 and/or 200.

In one exemplary embodiment, the data driving unit 500 and the gate driving unit 400 may repeat the same operations every ⅔ horizontal period (or alternatively, ½ H). In this manner, the gate turn on voltages are sequentially applied to the gate lines for one frame, and thus, the data voltages are applied to all pixels. After one frame has been ended, the next frame starts wherein the status of the reverse signal RVS applied to the data driving unit 500 is controlled such that the polarity of the data voltage applied to each pixel is reversed relative to the polarity of the data voltage in the previous frame (referred to as a frame inversion). Further, the polarity of the data voltage passing through one data line may be changed according to the characteristic of the reverse signal RVS even within one frame or the polarities of the data voltages simultaneously passing through the adjacent data lines may be different from each other (dot inversion and line inversion).

Hereinafter, the line inversion according to this embodiment will be explained with reference to the drawings.

Figure 6:
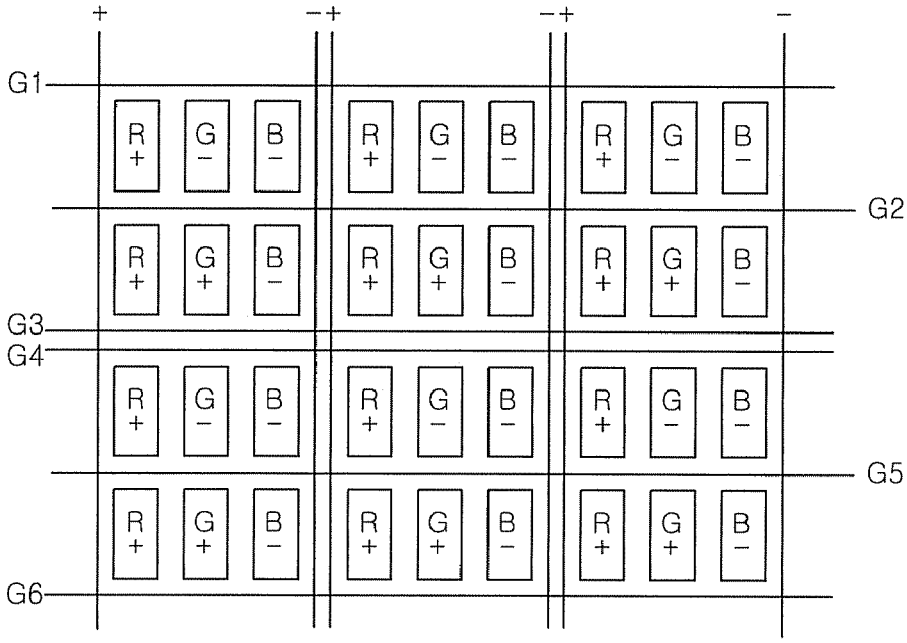
FIG. 6 is a diagram illustrating an exemplary embodiment of a polarity of the liquid crystal display shown in FIG. 4 during the line inversion thereof.

FIG. 6 is a diagram illustrating an exemplary embodiment of a polarity of the liquid crystal display shown in FIG. 4 during the line inversion thereof.

Referring to FIG. 6, the data voltages passing through one data line always have the same polarities and the data voltages passing through two data lines adjacent to the data line have the opposite polarities. That is, the pixels adjacent to data lines have the same polarities as the respective data line, and the top and bottom pixels disposed at the center between the data lines have the opposite polarities. In one preferred exemplary embodiment, if three pixels are disposed at the top and the bottom, respectively, of a repeated unit of the pixels the central pixels have opposite polarities. In another exemplary embodiment, the reverse pattern of the basic repeated unit may be repeated in a matrix form in the same manner.

Figure 7:
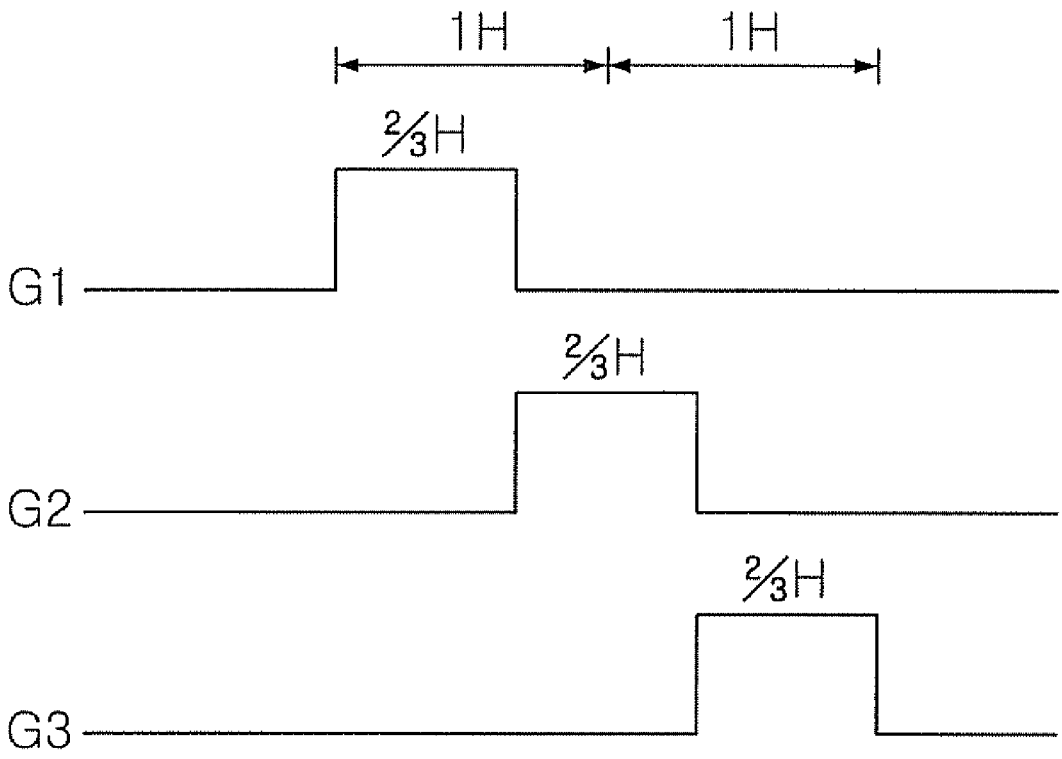
FIG. 7 is a waveform diagram of the gate driving of an exemplary embodiment of a liquid crystal display according to the present invention.

FIG. 7 is a waveform diagram of the gate driving of an exemplary embodiment of a liquid crystal display according to the present invention.

Referring to FIG. 7, the data signals are supplied, for a period of 2H, to the pixels disposed in a row direction and connected to three gate lines. That is, the data signals are charged into the pixels by driving each of gate lines for a period of ⅔H.

Referring to FIGS. 3, 4 and 7, the gate turn on voltage is first applied to the first gate line for the first ⅔H to supply the data signals to the first and third pixels connected to the first gate line. The gate turn on voltage is applied to the second gate line for the second ⅔H to supply the data signals to the second and fifth pixels connected to the second gate line. The gate turn on voltage is applied to the third gate line for the third ⅔H to supply the data signals to the fourth and sixth pixels connected to the third gate line.

The data signals may be sufficiently charged into the pixels for a period of ⅔H. In other exemplary embodiments, the charging ratio of the data signals into the pixels may be further increased through the pre-charging. In one exemplary embodiment, it may be effective that the first to third gate lines are overlapped for a certain period and the data signals are pre-charged for the overlapped period. In one preferred exemplary embodiment, the overlapped period is within a range of ⅓H to 1H. Advantageously, since the charging time is increased, the horizontal blurs do not occur during the N+1 driving.

Although it has been described in this embodiment that the gate turn on voltages are applied sequentially to the first, second and third gate lines, the present invention is not limited thereto. That is, the order of the gate turn on voltages to be applied may be changed.

Further, this invention is not limited to the above structures. The connections between the pixels and the gate lines or data lines in the aforementioned arrangement of the gate lines, the data lines and the pixels may be variously changed. Another exemplary embodiment of a liquid crystal display according to the present invention includes a modified connection relationship between the pixels and the gate lines or data lines. The descriptions same as those in the first embodiment will be omitted herein.

Figure 8:
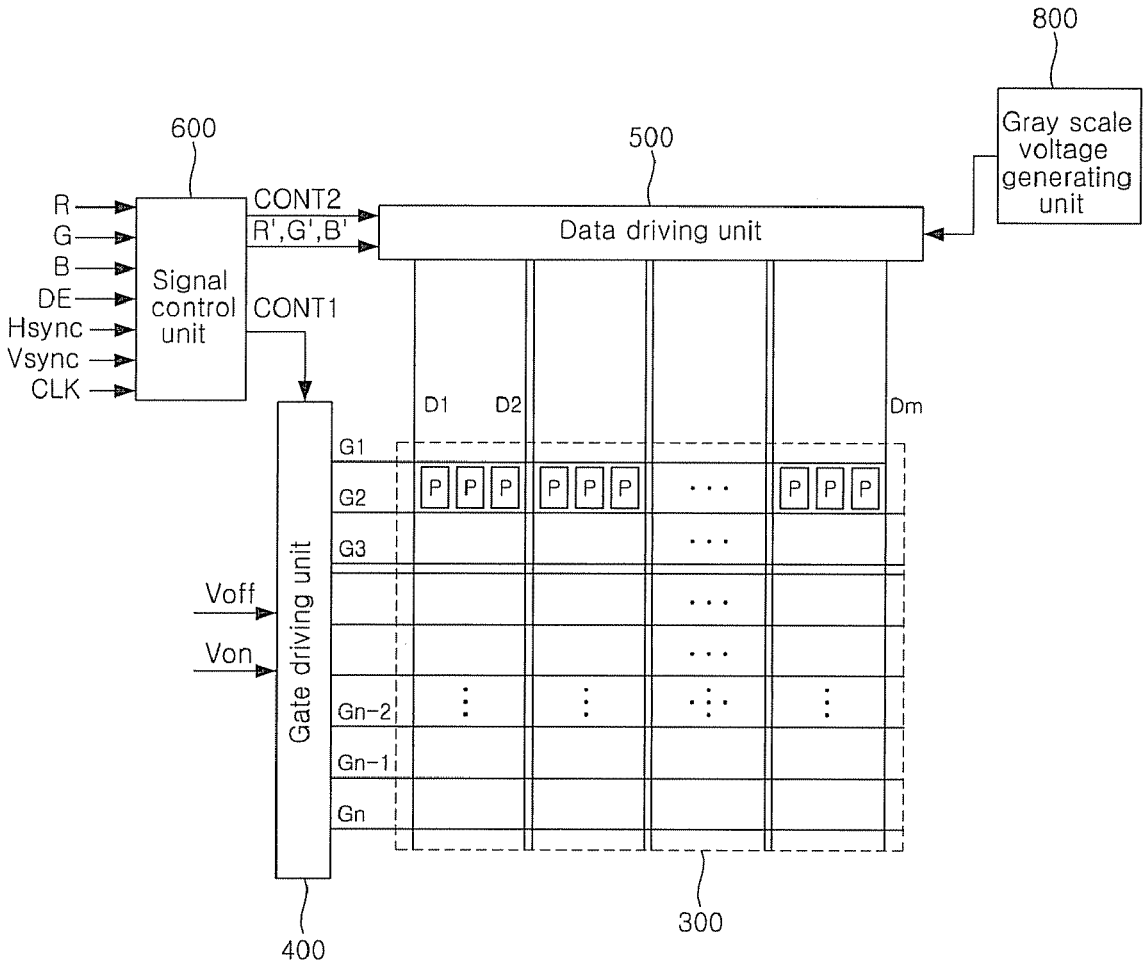
FIG. 8 is a block diagram of another exemplary embodiment of a liquid crystal display according to the present invention.
Figure 9:
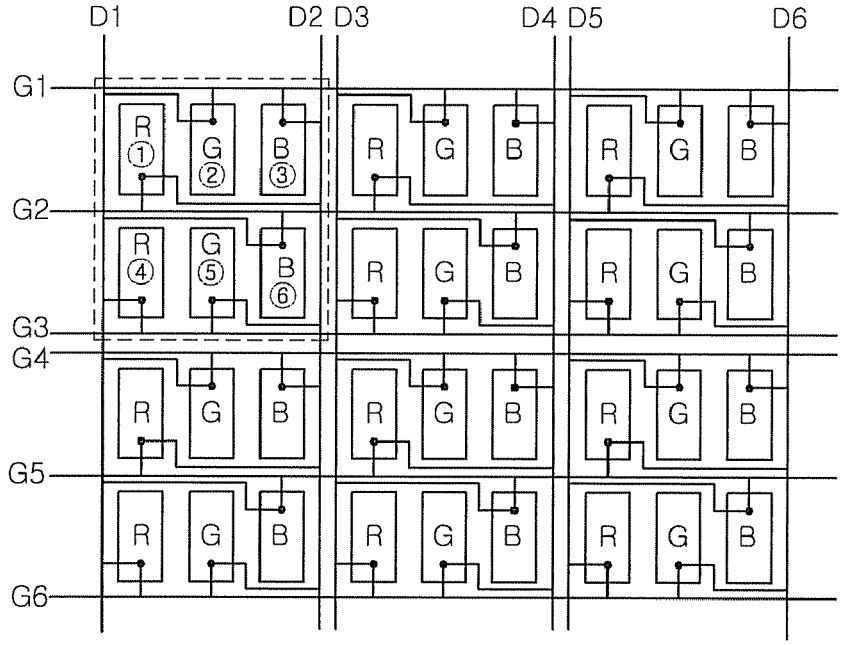
FIG. 9 is a schematic plan view of another exemplary embodiment of a liquid crystal display according to the present invention.
Figure 10:
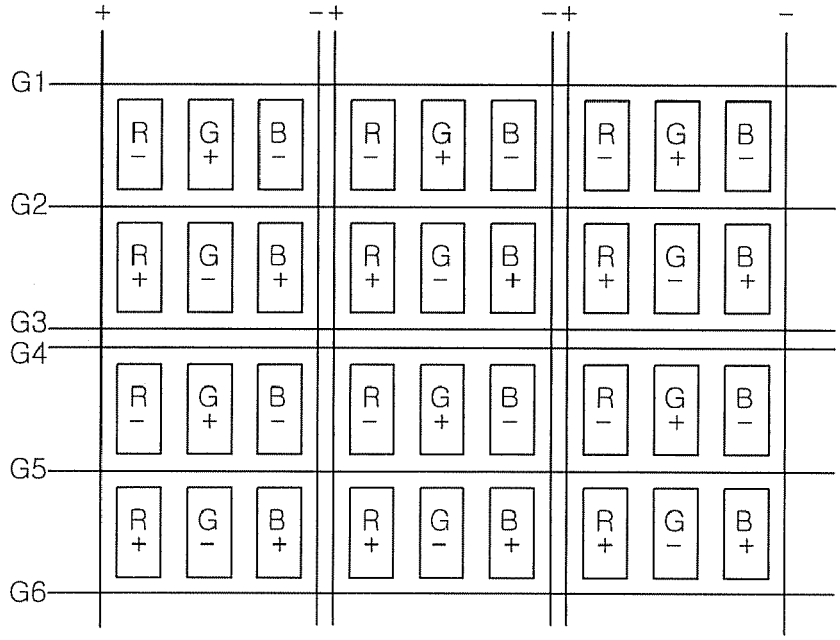
FIG. 10 is a diagram illustrating an exemplary embodiment of a polarity of the liquid crystal display shown in FIG. 9 during the line inversion thereof.

FIG. 8 is a block diagram of another exemplary embodiment a liquid crystal display according to the present invention. FIG. 9 is a schematic plan view of another exemplary embodiment of a liquid crystal display according to the present invention. FIG. 10 is a diagram illustrating an exemplary embodiment of a polarity of the liquid crystal display shown in FIG. 9 during the line inversion thereof.

Referring to FIG. 8, the liquid crystal display includes a liquid crystal panel assembly 300, a gate driving unit 400 and a data driving unit 500 connected to the liquid crystal panel assembly 300, a gray scale voltage generating unit 800 connected to the data driving unit 500 and a signal control unit 600 for controlling the assembly and units. At this time, the gate driving unit 400 is foiled at one side of the liquid crystal panel assembly 300. The gate driving unit 400 for driving the gate lines G1 to Gn may be disposed at the side of the liquid crystal panel assembly 300 in consideration of the margin thereof.

Referring to FIGS. 8 and 9, groups of three gate lines, such as G1 to G3 and G4 to G6, are disposed at the top, bottom and between two rows of pixels. The groups of gate lines are connected to the pixels through thin film transistors T. A group of pairs of data lines D1 and D2, D3 and D4, and D5 and D6 is disposed at the leftmost and rightmost sides of a group of pixels including three columns of pixels. The data lines are connected to the pixels through the thin film transistors T.

Three pixels are disposed at the top and bottom, respectively, of the group of pixels and two data lines D1 and D2, D3 and D4, and D5 and D6 are disposed at both sides of each group of the pixels, the data lines being disposed in substantially the column direction. Three gate lines G1 to G3 and G4 to G6 are disposed at both sides (such as top and bottom) and in the middle of the pixels in the row direction.

The first gate line G1 or G4 is connected to the second and third top pixels. The second gate line G2 or G5 is connected to the first top pixel and the third bottom pixel. The third gate line G3 or G6 is connected to the first and second bottom pixels.

The first data line D1, D3 or D5 is connected to the second top pixel and the first and third bottom pixels. The second data line D2, D4 or D6 is connected to the first and third top pixels and the second bottom pixel.

The repeated unit of the pixels includes six pixels consisting of three top pixels and three bottom pixels. The three top or bottom pixels include red (R), green (G) and/or blue (B) pixels. A plurality of the aforementioned repeated unit of pixels may be arranged in a matrix form.

Hereinafter, a first pixel in the first row is referred to as a first pixel, and the other two pixels in the first row are referred to as second and third pixels (as indicated by the circled numerals "1," "2" and "3"). Further, a first pixel in the second row is referred to as a fourth pixel, and the other two pixels in the second row are referred to as fifth and sixth pixels (as indicated by the circled numerals "4," "5" and "6"). In addition, the gate lines of a group of three consecutive gate lines are referred to as first to third gate lines G1, G2 and G3, respectively, and the two adjacent data lines are referred to as first and second data lines D1 and D2.

The first pixel is connected to the second gate line G2 and the second data line D2, the second pixel is connected to the first line G1 and the first data line D1 and the third pixel is connected to the first gate line G1 and the second data line D2. Further, the fourth pixel is connected to the third gate line G3 and the first data line D1, the fifth pixel is connected to the third gate line G3 and the second data line D2 and the sixth pixel is connected to the second gate line G2 and the first data line D1.

As described above, the first and third top pixels (first and third pixels) are connected to one data line while the second top pixel (second pixel) is connected to the other data line. The first and third bottom pixels (fourth and sixth pixels) are connected to the other data line while the second bottom pixel (fifth pixel) is connected to the one data line. Of course, the present invention is not limited thereto but may be variously changed according to the connection relationship between the pixels and the gate lines.

In one exemplary embodiment, the first pixel is connected to the first gate line G1 and the first data line D1, the second pixel is connected to the first line G1 and the second data line D2, and the third pixel is connected to the second gate line G2 and the first data line D1. Further, the fourth pixel is connected to the third gate line G3 and the second data line D2, the fifth pixel is connected to the second gate line G2 and the first data line D1, and the sixth pixel is connected to the second gate line G2 and the second data line D2.

The liquid crystal display so configured can perform a dot inversion, an N+1 inversion, a line inversion and a frame inversion. The line inversion will be explained with reference to FIG. 10.

Referring to FIG. 10, in the line inversion driving, the voltages passing through one data line have the same polarities as each other, and the data voltages passing through two data lines adjacent to the data line have the opposite polarities.

The three top pixels have reversed voltage characteristics against respective adjacent pixels, and the three bottom pixels have reversed voltage characteristics against the respective adjacent bottom pixels and also against the adjacent top pixels.

The connection relationship between the pixels and the data lines or gate lines as shown in FIG. 9 will be discussed below. When the first gate line G1 is driven, a positive data signal is charged into the second pixel connected thereto through the first data line D1 and a negative data signal is charged into the third pixel connected thereto through the second data line D2. When the second gate line G2 is driven, a negative data signal is charged into the first pixel connected thereto through the second data line D2 and a positive data signal is charged into the sixth pixel connected thereto through the first data line D1. When the third gate line G3 is driven, a positive data signal is charge into the fourth pixel connected thereto through the first data line D1 and a negative data signal is charged into the fifth pixel connected thereto through the second data line D2. Since the polarities of the pixels disposed at the top, bottom, left and right sides thereof are opposite from one another different, a coupling ratio between the pixels is substantially uniform within a repeated unit of pixels. Advantageously, the brightness difference between the pixels within the repeated unit of pixels due to the pixel voltage difference can be reduced or effectively prevented.

In one exemplary embodiment, three top pixels and three bottom pixels are included in a repeated unit of pixels such that the color characteristic of each repeated unit of pixels may be uniform. Advantageously, a variety of blurs due to a coupling difference can be reduced or effectively prevented.

In another exemplary embodiment, since the pixels positioned at the top and the bottom can be driven for ⅔H by means of three gate lines, the charging margin of the data signal may be increased and an effect of the secondary kick-back can also be reduced. In addition, horizontal blurs may be reduced or effectively prevented during the N+1 inversion.

In another exemplary embodiment, since three top pixels and three bottom pixels are driven by three gate lines and two data lines, the gate lines can be reduced up to ¾ times and the data lines can also be reduced up to ⅓ times. Advantageously, the design margin and the aperture ratio of the liquid crystal display may be increased.

In another exemplary embodiment, as the numbers of the gate lines and data lines are reduced, the number of the driving ICs for driving the gate lines and data lines may also be reduced. Advantageously, the production costs of the liquid crystal display may be reduced. Further, since an area for the circuit for driving the gate lines may be increased when the circuit is provided on a substrate, a sufficient process margin may be obtained during the manufacture of the liquid crystal display.

In another exemplary embodiment, the brightness difference between the pixels and thus the blurs due to the brightness difference may be reduced or effectively prevented by changing the arrangement of the gate lines, the data lines and the pixels. Accordingly, a liquid crystal display with reduced power consumption, increased charging ratio of the pixel electrode, and improved visibility thereof may be obtained.

Although the present invention has been described with reference to the preferred embodiments illustrated in connection with the accompanying drawings, the present invention is not limited thereto but is defined by the appended claims. Therefore, it will be readily understood by those skilled in the art that various modifications and changes can be made thereto without departing from the spirit and scope of the present invention defined by the appended claims.

What is claimed is:

1. A liquid crystal display, comprising:

a substrate;

a first and a second row of pixels each formed on the substrate and including a plurality of pixels;

a first gate line extending in a row direction on the substrate and connected to the first row of pixels;

a second gate line extending in the row direction on the substrate and connected to the first and second rows of pixels;

a third gate line extending in the row direction on the substrate and connected to the second row of pixels; and first and second data lines each extending in a column direction on the substrate to transmit a data voltage to a pixel group consisting of three columns of pixels, wherein two of the three adjacent pixels in the first row of pixels are connected to the first gate line, the other pixel in the first row of pixels and one of the three pixels in the second row of pixels are connected to the second gate line, and the other two pixels in the second row of pixels are connected to the third gate line.

2. The liquid crystal display as claimed in claim 1, further comprising:

a first gate driving unit connected to the first gate line and the third gate line; and a second gate driving unit connected to the second gate line.

3. The liquid crystal display as claimed in claim 2, wherein the first and second gate driving units are integrated on the substrate.

4. The liquid crystal display as claimed in claim 2, wherein the first and second gate driving units are integrated to be opposite to each other in the row direction.

5. The liquid crystal display as claimed in claim 2, wherein the first and second gate driving units are configured to sequentially apply gate turn on voltages to the first, second and third gate lines for two horizontal periods (2H).

6. The liquid crystal display as claimed in claim 5, wherein the gate turn on voltages applied to the first, second and third gate lines are overlapped for ⅓ to 1 horizontal period.

7. The liquid crystal display as claimed in claim 1, wherein polarities of the data voltages applied respectively to the first and second data lines are different from each other.

8. The liquid crystal display as claimed in claim 1, wherein polarities of the data voltages applied respectively to the first and second data lines are different for adjacent pixels.

9. The liquid crystal display as claimed in claim 1, wherein polarities of the data voltages applied respectively to the first and second data lines are different for every frame.

10. The liquid crystal display as claimed in claim 1, wherein at least one of three adjacent pixels in the first row of pixels is connected to the first data line while the other of the three pixels in the first row of pixels are connected to the second data line and at least one of three pixels in the second row of pixels is connected to the second data line while the others of the three pixels in the second row of pixels are connected to the first data line.

11. The liquid crystal display as claimed in claim 1, wherein each first column of pixels in the first and second rows of pixels is connected to the first data line, each second column of pixels in the first and second rows of pixels is connected to the first or second data line and each third column of pixels in the first and second rows of pixels is connected to the second data line.

12. The liquid crystal display as claimed in claim 11, wherein two of three consecutive pixels in the first row of pixels are connected to the first data line while the other of the three pixels in the first row of pixels is connected to the second data line, and two of three pixels in the second row of pixels are connected to the second data line while the other of the three pixels in the second row of pixels is connected to the first data line.

13. A method for driving a liquid crystal display comprising a substrate, first and second rows of pixels each formed on the substrate and including a plurality of pixels, a first gate line extending in a row direction on the substrate and connected to the first row of pixels, a second gate line extending in the row direction on the substrate and connected to the first and second rows of pixels, a third gate line extending in the row direction on the substrate and connected to the second row of pixels, and first and second data lines extending in a column direction on the substrate to transmit data voltages to a pixel group consisting of three columns of pixels, wherein two of the three adjacent pixels in the first row of pixels are connected to the first gate line, the other pixel in the first row of pixels and one of the three pixels in the second row of pixels are connected to the second gate line, and the other two pixels in the second row of pixels are connected to the third gate line, the method comprising:

applying the data voltages to the first and second data lines; and applying gate turn on voltages to the first, second and third gate lines, respectively, for two horizontal periods (2H).

14. The method as claimed in claim 13, wherein the gate turn on voltages are applied to the first, second and third gate lines, respectively, for at least ⅔ horizontal period.

15. The method as claimed in claim 13, wherein the gate turn on voltages applied to the first, second and third gate lines are overlapped with one another for ⅓ to 1 horizontal period.

16. The method as claimed in claim 13, wherein polarities of the data voltages applied respectively to the first and second data lines are different from each other.

17. The method as claimed in claim 13, wherein polarities of the data voltages applied respectively to the first and second data lines are different for adjacent pixels.

18. The method as claimed in claim 13, wherein polarities of the data voltages applied respectively to the first and second data lines are different for every frame.

19. A method of forming a liquid crystal display comprising:

forming first and second rows of pixels on a substrate, each of the first and second rows of pixels comprising a plurality of pixels defining a pixel group comprising three columns of pixels;

disposing a first gate line, a second gate line and a third gate line on the substrate, the first gate line, second gate line and third gate line extending in a row direction; and disposing first and second data lines on the substrate in a column direction;

wherein the first and second data lines transmit a data voltage to the pixel group;

wherein two of the three adjacent pixels in the first row of pixels are connected to the first gate line, the other pixel in the first row of pixels and one of the three pixels in the second row of pixels are connected to the second gate line, and the other two pixels in the second row of pixels are connected to the third gate line, and wherein the first gate line is connected to the first row of pixels, the second gate line is connected to the first and second row of pixels and the third gate line is connected to the second row of pixels.

20. The method as claimed in claim 19, wherein the three columns of pixels in the first and second rows of pixels comprise the same numbers of red pixels, green pixels and blue pixels each having the same area.

21. The method as claimed in claim 19, wherein each pixel comprises a switching element connected to any one of the first to third gate lines and any one of the first and second data lines.

22. The liquid crystal display as claimed in claim 1, wherein each of the first to third gate lines is connected to ⅓ pixels of the pixels included in the pixel group.

23. The method as claimed in claim 13, wherein each of the first to third gate lines is connected to ⅓ pixels of the pixels included in the pixel group.

24. The method as claimed in claim 19, wherein each of the first to third gate lines is connected to ⅓ pixels of the pixels included in the pixel group.

25. The liquid crystal display as claimed in claim 1, wherein the first and second data lines of the pixel group are different from the first and second data lines of an adjacent pixel group, and each of the first and second data lines is connected to half of the pixels of the pixel group.

* * * * *